United States Patent [19]

Abinett

[11] Patent Number: 4,711,618

[45] Date of Patent: Dec. 8, 1987

[54] FUEL INJECTION PUMPS

[75] Inventor: Raymond E. Abinett, Rochester, England

[73] Assignee: Lucas Industries Public Limited Company, Birmingham, England

[21] Appl. No.: 56,542

[22] Filed: Jun. 1, 1987

[30] Foreign Application Priority Data

Jun. 3, 1986 [GB] United Kingdom ..... 8613409

[51] Int. Cl.[4] ..... F04B 19/22; F04B 29/00; F04B 49/00

[52] U.S. Cl. ..... 417/462; 123/450

[58] Field of Search ..... 417/462; 123/450

[56] References Cited

U.S. PATENT DOCUMENTS 4,358,255 11/1982 Brotherston ..... 417/462

4,438,747 3/1984 Skinner ..... 417/462

4,462,370 7/1984 Jarrett ..... 417/462

*Primary Examiner*—William L. Freeh

*Attorney, Agent, or Firm*—Balogh, Osann, Kramer, Dvorak, Genova & Traub

[57] ABSTRACT

A fuel injection pump has a rotary and axially slidable distributor member housed in a sleeve in which is formed a series of outlet ports and a series of inlet ports the two series of parts being in axially spaced planes. The distributor member has an outlet groove for registration with the outlet ports in turn and an inlet groove for registration in turn with the inlet ports. The two grooves communicate with a pumping plunger bore so that as the distributor member rotates fuel will be supplied to the bore through an inlet port and the inlet groove and will flow from the bore through the outlet groove and an outlet port. Interconnected balancing grooves are provided on the distributor member for communication with the outlet ports and inlet ports respectively to ensure that following delivery of fuel through an outlet port, that port will be connected to an inlet port before the next delivery of fuel through the port takes place.

1 Claim, 2 Drawing Figures

FUEL INJECTION PUMPS

This invention relates to rotary distributor fuel injection pumps of the kind comprising a rotary distributor member which is mounted within a cylindrical bore defined in a fixed body part, the distributor member defining a plunger bore in which is mounted a reciprocable plunger, the plunger during inward movement under the action of cam means displacing fuel from said plunger bore, a passage in the distributor member which receives fuel from the bore during the inward movement of the plunger, a plurality of angularly spaced outlet ports formed in the body and opening onto the surface of the cylindrical bore, a delivery groove on the periphery of the distributor member, said delivery groove registering with said outlet ports in turn during successive inward movements of the plunger, a plurality of angularly spaced inlet ports formed in the body and opening onto the surface of the cylindrical bore, the inlet ports and outlet ports being disposed in axially spaced planes respectively, said inlet ports communicating with a source of fuel under pressure, at least one inlet groove on the periphery of the distributor member and positioned to register in turn with said inlet ports to allow fuel to flow into said plunger bore during the time the plunger is allowed to move outwardly by said cam means, and stop means for limiting the outward movement of the plunger, said stop means being constructed so that the extent of outward movement of the plunger depends upon the axial position of the distributor member within the cylindrical bore.

The axial spacing of the inlet ports and the delivery ports is necessary when the pump is required to deliver fuel at a very high pressure to a so-called direct injection compression ignition engine. It is known in the art to stabilise the pressure in the outlet ports following delivery of fuel therethrough, in order to achieve regularity of fuel delivery. Where the delivery ports and the inlet ports lie in the same plane this is achieved using a single balancing groove which is so disposed on the surface of the distributor member and which has a width sufficient to achieve communication between an outlet port which has received fuel and the inlet port which precedes the outlet port in the direction of rotation of the distributor member. In such a pump the roles of the inlet groove and delivery groove are combined and the balancing groove can be positioned on the distributor member so as to ensure that at some time between successive fuel deliveries to each outlet port, that outlet port is placed in communication with an inlet port.

Where the inlet ports and grooves are axially spaced, a single balancing groove would be undesirably long since because of the axial movement of the distributor member it would have to have a length greater than the spacing between the aforesaid planes by at least the allowed axial movement of the distributor member. The formation of such a groove would result in a substantial reduction in the bearing surface of the distributor member and in addition, the loss would be concentrated in one area of the distributor member.

The object of the present invention is to provide an injection pump of the kind specified in a simple and convenient form.

According to the invention a rotary distributor fuel injection pump of the kind specified comprises first and second balancing grooves formed on the periphery of the distributor member for communication with the inlet ports and outlet ports respectively, a passage extending within the distributor member and interconnecting the balancing grooves, said balancing grooves effecting communication as the distributor member rotates, between each outlet port and an inlet port to stabilise the fuel pressure in the outlet ports.

An example of an injection pump in accordance with the invention will now be described with reference to the accompanying drawings in which.

Figure 1:
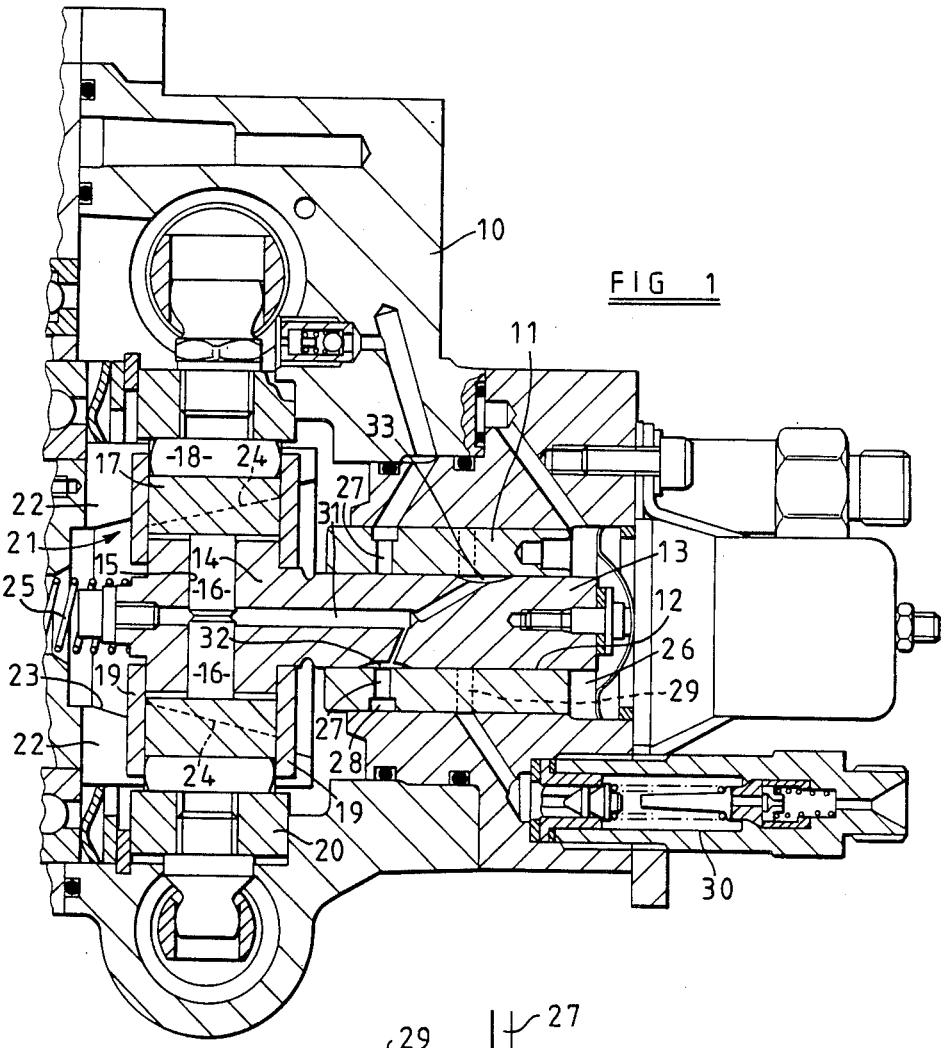
FIG. 1 is sectional side elevation showing a portion of the pump.

Referring to FIG. 1 of the drawings the pump comprises a multi-part body 10 in which is mounted a sleeve 11 which defines a cylindrical bore 12 which accommodates an axially movable rotary distributor member 13. The distributor member projects from the bore 12 and has an enlarged portion 14 in which is formed a diametrically disposed plunger bore 15 which mounts a pair of pumping plungers 16. The plungers at their outer ends are engaged by cam followers each of which includes a shoe 17 and a roller 18. The shoes and rollers are confined between a pair of plates 19 secured to the enlarged portion 14 of the distributor member and the rollers can engage with cam lobes formed on the internal peripheral surface of a cam ring 20 which is angularly adjustable within the body of the pump in known manner, to achieve variation in the timing of fuel delivery.

The distributor member is driven by means of a drive shaft which is supported in the body and which has an annular head 21 which surrounds the enlarged portion 14 of the distributor member. The head is provided with a pair of axially extending radial slots 22 in which are located the drive plates 19 and the cam followers and in addition, the internal surface of the head 21 is tapered to provide a stop surface 23 and for co-operation with the stop surface 23, each shoe 17 is provided on its opposite sides, with stop surfaces 24 which are shown in dotted outline.

The distributor member is biased by means of a coiled compression spring 25 interposed between the distributor member and the enlarged portion of the drive shaft and movement of the distributor member against the action of this spring is achieved by admitting fuel under pressure to a chamber 26 at the opposite end of the distributor member, the control of the pressure in the chamber being conveniently effected by an electrically controlled valve.

Formed in the sleeve 11 is a series of inlet ports 27 which communicate with a circumferential groove 28 formed on the periphery of the sleeve and which extend inwardly to open onto the cylindrical surface of the bore 12. The groove 28 communicates with a source of fuel under pressure conveniently a low pressure pump which is driven by the drive shaft. The ports 27 are equiangularly spaced and as will be seen from FIG. 2, four inlet ports are provided. Also formed in the sleeve are four outlet ports 29 which are connected to outlets 30 respectively formed in the body and connected in use to the injection nozzles respectively of the associated engine. Each outlet can incorporate a delivery valve. The outlet ports 29 are also equiangularly spaced and are located in a plane normal to the axis of rotation of the distributor member, which is axially spaced from a similar plane containing the inlet ports 27. From FIG. 2 it will be seen that the inlet and outlet ports are alternately spaced about the axis of rotation of the distributor member.

Figure 2:
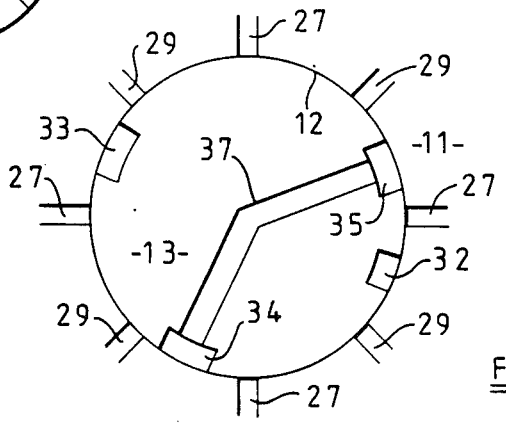
FIG. 2 is diagrammatic view to an enlarged scale showing the disposition of various ports and grooves in the pump.

The plunger bore 15 communicates with an axial passage 31 formed in the distributor member. This passage communicates with a longitudinal inlet groove 32 and a longitudinal outlet groove 33, the two grooves being axially spaced in the same manner as the inlet and outlet ports. It will of course be understood that FIG. 2 is diagrammatic and the groove 32 can register only with the inlet ports 27 and the groove 33 only with the outlet ports 29. As the distributor member rotates therefore the groove 33 will move into register with an outlet port 29 just before inward movement of the pumping plungers 16 can take place and during the inward movement of the plungers fuel will be displaced to an outlet. As the distributor member further rotates the groove 33 will move out of register with an outlet 29 and the groove 32 will move into register with an inlet port 27 to permit the plungers to be moved outwardly by the action of fuel under pressure. The outward movement of the plungers causes similar movement of the followers and the outward movement of the plungers and followers will be arrested when the stop surfaces 24 on the shoes engage with the stop surface 23. The extent of outward movement of the plungers depends upon the axial position of the distributor member and it will be understood that as the distributor member is moved towards the right as shown in FIG. 1, further outward movement of the plungers will be allowed so that an increased quantity of fuel will be supplied through each outlet.

In order to stabilise the fuel pressure in each outlet port following delivery of fuel and before the next delivery of fuel to that port, a pair of balancing grooves 34, 35 are formed in the periphery of the distributor member as seen in FIG. 2 and are interconnected by a passage 37 conveniently formed in two parts. The grooves 34 and 35 are axially spaced by an amount equal to the separation of the aforesaid planes so that the groove 34 can communicate only with the outlet ports 29 while the groove 35 can communicate only with the inlet ports 27. The arrangement is such therefore that as the distributor member rotates each outlet port between successive deliveries of fuel thereto, will be connected to an inlet port so as to permit the pressure in the outlet port to stabilise before it next receives fuel. The lengths of the grooves 34, 35 are substantially equal to those of the grooves 32, 33 being such as to take into account the allowed axial movement of the distributor member. The widths of the grooves 34, 35 are comparable to the widths of the grooves 32, 33 and although the grooves 34 and 35 are not diametrically disposed, so that full balance of the forces acting on the distributor member is not obtained, the improvement is significant as compared with the use of a single groove described in the opening of the present specification.

I claim:

1. A rotary distributor fuel injection pump comprising a rotary distributor member which is mounted within a cylindrical bore defined in a fixed body part, the distributor member defining a plunger bore in which is mounted a reciprocable plunger, the plunger during inward movement under the action of cam means displacing fuel from said plunger bore, a passage in the distributor member which receives fuel from the bore during the inward movement of the plunger, a plurality of angularly spaced outlet ports formed in the body and opening onto the surface of the cylindrical bore, a delivery groove on the periphery of the distributor member, said delivery groove registering with said outlet ports in turn during successive inward movements of the plunger, a plurality of angularly spaced inlet ports formed in the body and opening onto the surface of the cylindrical bore, the inlet ports and outlet ports being disposed in axially spaced planes respectively, said inlet ports communicating with a source of fuel under pressure, at least one inlet groove on the periphery of the distributor member and positioned to register in turn with said inlet ports to allow fuel to flow into said plunger bore during the time the plunger is allowed to move outwardly by said cam means, stop means for limiting the outward movement of the plunger, said stop means being constructed so that the extent of outward movement of the plunger depends upon the axial position of the distributor member within the cylindrical bore, first and second balancing grooves formed on the periphery of the distributor member for communication with the inlet ports and outlet ports respectively, a passage extending within the distributor member and interconnecting the balancing grooves, said balancing grooves effecting communication as the distributor member rotates, between each outlet port and an inlet port to stabilise the fuel pressure in the outlet ports.

* * * * *